US008317541B2

(12) United States Patent
Kikuchi

(10) Patent No.: US 8,317,541 B2
(45) Date of Patent: Nov. 27, 2012

(54) CONNECTOR WITH OPEN UPPER SURFACE COMMUNICATING WITH CAVITIES AND SLIDABLE COVER FOR COVERING CAVITIES

(75) Inventor: Takahiro Kikuchi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/079,884

(22) Filed: Apr. 5, 2011

(65) Prior Publication Data

US 2011/0244726 A1 Oct. 6, 2011

(30) Foreign Application Priority Data

Apr. 6, 2010 (JP) ..... 2010-087773

(51) Int. Cl.
*H01R 13/40* (2006.01)

(52) U.S. Cl. ..... 439/595

(58) Field of Classification Search ..... 439/595, 439/594, 598, 752

See application file for complete search history.

(56) References Cited

U.S. PATENT DOCUMENTS

| | | | | |
|---|---|---|---|---|
| 5,100,345 | A | 3/1992 | Endo et al. | |
| 5,286,225 | A | 2/1994 | Tsuji | |
| 6,244,901 | B1 | 6/2001 | Fujii et al. | |
| 2004/0087209 | A1 * | 5/2004 | Nakamura | 439/595 |
| 2005/0181664 | A1 | 8/2005 | Fukuzaki et al. | |
| 2006/0172597 | A1 * | 8/2006 | Nakamura et al. | 439/595 |
| 2007/0046293 | A1 | 3/2007 | Nakamura et al. | |
| 2007/0238353 | A1 * | 10/2007 | Yamaoka | 439/595 |

FOREIGN PATENT DOCUMENTS

| | | |
|---|---|---|
| JP | 7-272799 | 10/1995 |

* cited by examiner

*Primary Examiner* — Amy Cohen Johnson

*Assistant Examiner* — Vladimir Imas

(74) *Attorney, Agent, or Firm* — Gerald E. Hespos; Michael J. Porco

(57) ABSTRACT

An opening (K) is formed in one side surface of a housing (1) to expose cavities (5) inside. Retaining portions (8) are formed in the cavities (5) to prevent female terminal fittings (7) accommodated from above the opening (K) from coming out backward by engaging the female terminal fittings (7). A cover member (2) includes a cover (15), which is slid along a plane direction of the opening (K) from a rear side of the housing (1). When the opening (K) is closed by the cover (15), thinned portions (36) of the cover (15) slip under locking walls (19) to prevent the cover (15) from coming out upward. Further, a lock arm (28) of the housing (1) is engaged with a locking edge of the cover member (2), whereby the cover member (2) is mounted on the connector housing (1).

20 Claims, 9 Drawing Sheets

CONNECTOR WITH OPEN UPPER SURFACE COMMUNICATING WITH CAVITIES AND SLIDABLE COVER FOR COVERING CAVITIES

BACKGROUND OF THE INVENTION

1. Field of the Invention

The invention relates to a connector.

2. Description of the Related Art

Japanese Unexamined Patent Publication No. H07-272799 discloses a connector with a housing that has an open upper surface so that cavities inside are entirely exposed. A cover is mounted on the housing from above after terminal fittings are accommodated into the cavities. Resiliently deformable locking pieces hang down from the peripheral edge of the cover and engage lock projections on outer surfaces of the housing to lock the cover on the housing.

However vertical clearances are formed between the locking pieces and the lock projections. Thus, the cover is likely to shake vertically after being mounted. Then, the terminal fittings accommodated inside may be pressed insufficiently and may be accommodated obliquely inside. The leading end of an obliquely aligned terminal fitting may be displaced from a proper position and may hinder a smooth connecting operation of terminal fittings when a mating tab-shaped terminal fitting is inserted from the front.

A main reason for these problems lies in the construction for mounting the cover onto the housing from above.

The invention was developed in view of the above situation and an object thereof is to provide a connector capable of effectively preventing shaking movements of terminal fittings accommodated inside.

SUMMARY OF THE INVENTION

The invention is directed to a connector with a housing formed with at least one cavity for accommodating at least one terminal fitting. The housing formed has an opening formed in at least one side surface to expose the cavity over substantially the entire length and the terminal fitting can be accommodated into the cavity through the opening. At least one restriction is formed rigidly in the housing. The restriction engages the terminal fitting for retaining the terminal fitting and preventing the terminal fitting from coming out backward in a longitudinal direction. A cover is mounted on the housing to open and/or close the opening in a plane direction of the opening. Therefore, the cover can be slid substantially along the plane direction of the opening to close the opening.

The cover preferably is slid in the longitudinal direction of the terminal fitting, which is the plane direction of the opening, to be mounted. Guides are formed on facing surfaces of the opening and extend substantially in the longitudinal direction of the terminal fitting for guiding a sliding movement of the cover along the longitudinal direction of the terminal fitting when opening and/or closing the opening. Thus, clearances between the cover and the guides in a direction orthogonal to the sliding direction can be made as small as possible. Therefore, the cover reliably restricts shaking movements of the terminal fitting in the cavity, and a connecting operation with a mating terminal fitting can be performed smoothly.

The housing preferably has a front wall at a front end in the longitudinal direction of the terminal fitting. The front wall preferably has an insertion hole for a tab-shaped terminal as a connection partner of the terminal fitting and at least one guiding surface arranged substantially around the terminal hole.

The cover preferably contacts a part of the inner surface of the front wall overlapping an area corresponding to the guiding surface to define a front end position of the cover. Accordingly, a closing direction of the slidable cover is from the rear toward the front of the terminal fitting in the longitudinal direction, and the front end position of the cover is defined by the contact with the front wall of the housing. The guiding surface formed in the front surface of the front wall is ensured in this way to fulfill a function of guiding the mating terminal fitting.

The defined front end position of the cover can be set in a projection range of an area of the inner surface of the front wall where the guiding surface is formed. Thus, the connector can be made smaller.

A restricting wall preferably projects in from the inner surface of the front wall for preventing a leading end of the terminal fitting from being lifted up by pressing an upper part of the leading end portion of the terminal fitting. Accordingly, the terminal fitting is accommodated into the cavity while the leading end thereof slips under the restricting wall. Thus, the leading end of the terminal fitting is pressed and prevented from being lifted up by the restricting wall before the opening is closed by the cover portion. Therefore, a closing operation of the cover can be performed smoothly.

One or more leading end surfaces of the restricting walls define stoppers that contact the cover to define a front end position of the cover when the cover is closed.

The cover is mounted on the housing to be substantially flush with a wall surface of the housing around the cover. Accordingly, the entire connector can be made smaller since the cover is mounted on the housing to be substantially flush with the wall surface around it.

Reinforcements are provided at a base end of the cover.

A sliding direction of the cover when the cover at least partly closes the opening is set at a direction from the rear toward the front of the housing.

These and other objects, features and advantages of the invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
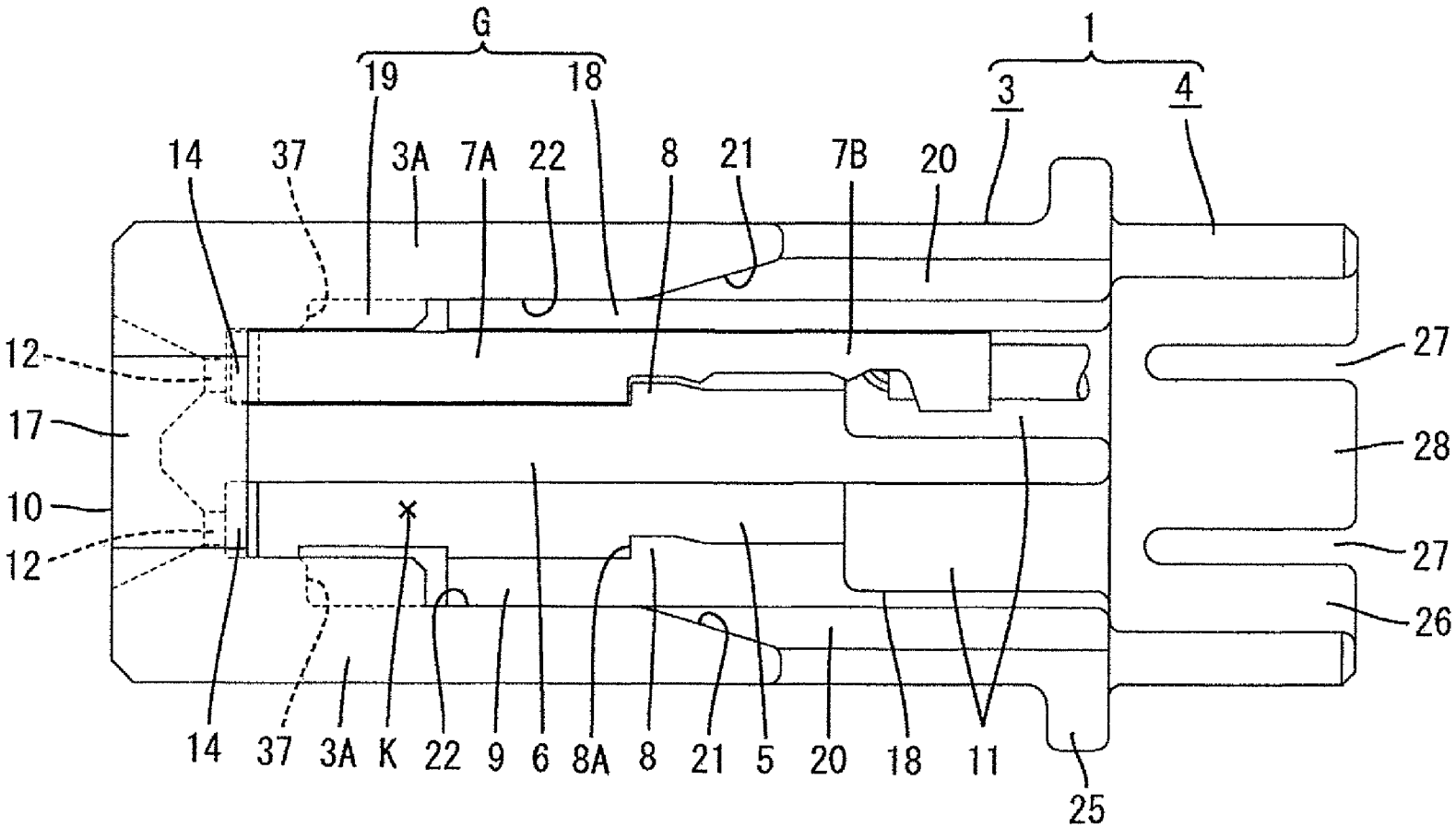
FIG. 1 is a plan view of a connector housing.
Figure 7:
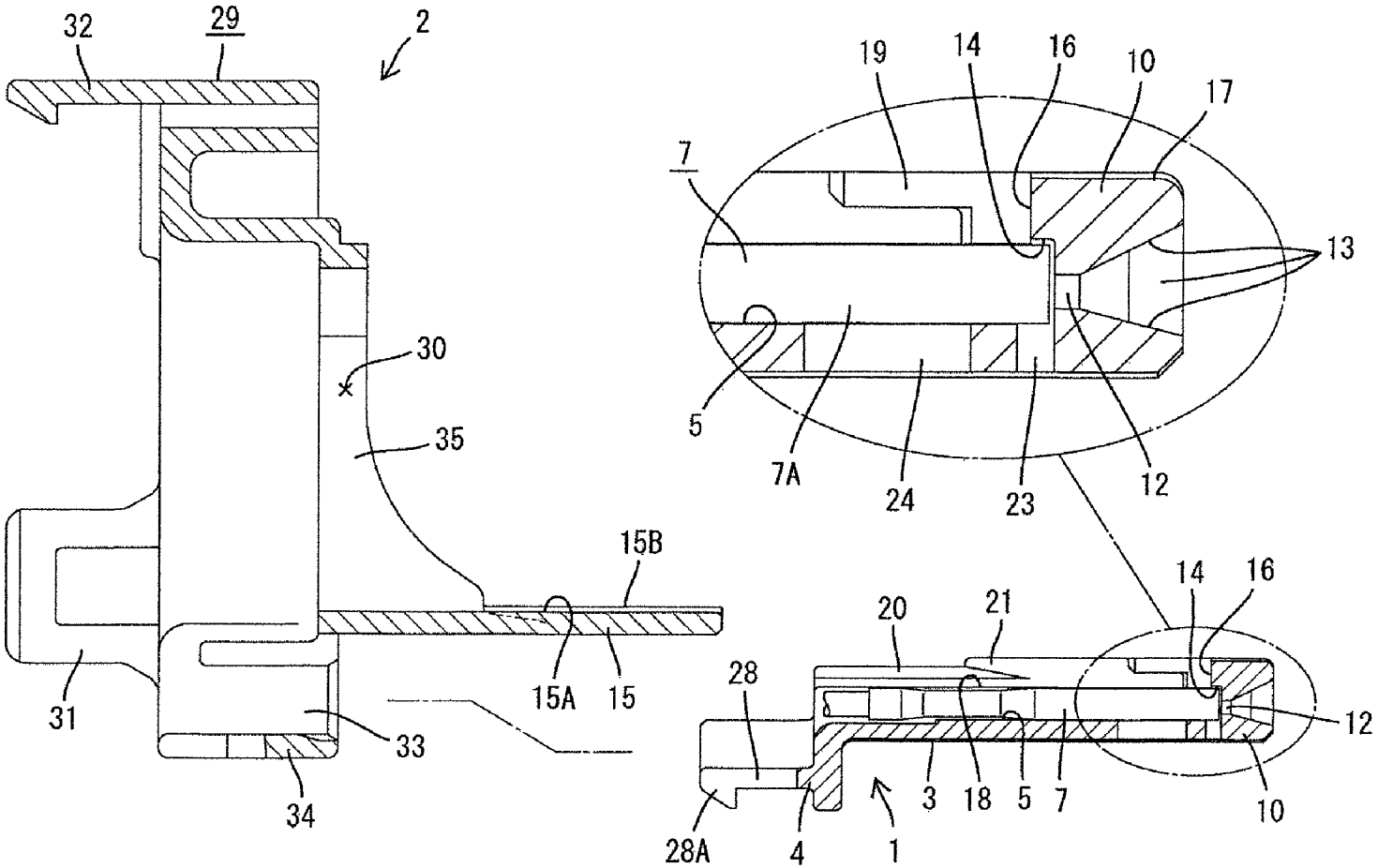
FIG. 7 is a side view in section showing the cover and the connector housing.

In the following description, left and right sides in FIG. 1 are referred to respectively as front and rear ends concerning forward and backward directions, and vertical direction is based on that in FIG. 7.

The illustrated connector is to be incorporated into a shift lever device for an automatic transmission of an automotive vehicle. The connector has a housing 1 and a cover 2.

The housing 1 is formed integrally or unitarily e.g. of synthetic resin. The housing 1 includes a main portion 3 for accommodating female terminal fittings and a connecting portion 4 formed unitarily at a rear end for connection with the cover 2. The main portion 3 has an opening K in an upper surface thereof to expose cavities 5 inside.

A partition wall 6 projects from a widthwise central part of the inner bottom surface of the main portion 3 and extends in forward and backward directions over at least part of, particularly over substantially the entire length of the main portion 3. The interior of the main portion 3 is partitioned in a width direction into chambers by the partition wall 6, and the chambers define the cavities 5 for accommodating female terminal fittings 7. Both female terminal fittings 7 can be accommodated into the cavities 5 through the opening K.

The female terminal fitting 7 includes a substantially rectangular or polygonal tube 7A at a front end for receiving and electrically connecting with a tab-shaped terminal (not shown). A wire connection barrel 7B is formed at a rear end of the female terminal fitting 7 for connection with a wire and is connected to the tube 7A via a coupling 7C.

Restricting portions 8 are arranged in the cavities 5 for preventing backward movements of the female terminal fittings 7. Specifically, one restricting portion 8 projects toward the interior of one cavity 5 from a substantially longitudinal central part of the partition wall 6, and the other similarly is formed on a side wall 9 of the other cavity 5. The restricting portions 8 have substantially the same height as the partition wall 6. Front end surfaces 8A of the restricting portions 8 are substantially perpendicular to the longitudinal direction of the female terminal fittings 7 and engage steps continuous with the couplings 7C at the rear ends of the tubes 7A of the female terminal fittings 7. Thus, movements of the female terminal fittings 7 are prevented if the wires are pulled.

The heights of the partition wall 6 and a part of the side wall 9 where the other restricting portion 8 is formed are lower than opposite side wall surfaces 3A of the main portion 3 extending in the longitudinal direction and a front wall 10. Both cavities 5 have the same height as the partition wall 6. This height particularly is equal to or slightly higher than the height of the tubes 7A (dimension in an accommodating direction into the cavities 5). Sides of the cavities 5 before the restricting portions 8 are formed in conformity with the side surface shapes of the rectangular tubes 7A of the female terminal fittings 7 so that the rectangular tubes 7A are accommodated entirely and very closely. A length area of each cavity 5 corresponding to the restricting portion 8 has a width so that the coupling 7C and a part of the barrel 7B can be accommodated with a sufficient clearance, and a length area behind the restricting portion 8 is widened to form an escape area 11 for the remaining part of the barrel 7B and a wire end.

Tab insertion holes 12 penetrate through the front wall 10 of the main portion 3 substantially in correspondence with the cavities 5 for allowing insertion of the tab-shaped terminals. Each tab insertion hole 12 is formed to align with an opening in the front end of the tube 7A when the female terminal fitting 7 is accommodated in the cavity 5. Guiding surfaces 13 are formed at the front surface of the front wall 10 around each tab insertion hole 12. The guiding surfaces 13 are inclined to taper toward the tab insertion hole 12 so that the tab-shaped terminal can be guided to the tab insertion hole 12 along the respective inclined guiding surfaces 13.

A restricting wall 14 projects substantially horizontally into the cavity 5 from the upper edge of the inner surface of the front wall 10 and extends over substantially the entire width of each cavity 5 for preventing the leading end of the female terminal fitting 7 from being lifted up. The lower surface of this restricting wall 14 particularly is substantially at the same height as the upper surface of the partition wall 6. Rear end edges of the restricting walls 14 define stoppers 16 that contact the leading end of the cover 15 to define a front end position of the cover 15 when the cover 15 is closed. The height of the stoppers 16 is set in a range overlapping a height range where the guiding surfaces 13 are provided, as shown in FIG. 7. A downwardly concave arcuate surface 17 is formed in a width area of the upper surface of the front wall 10 corresponding to the restricting walls 14. This arcuate surface 17 is formed with a curvature in conformity with the outer peripheral surface shape of a shaft of an unillustrated shift lever.

A guide G is provided for guiding a closing movement of the cover 2 relative to the housing 1. The guide G includes supporting stepped surfaces 18 and locking walls 19. The supporting stepped surfaces 18 support opposite widthwise edges of the cover 2 and are formed on rear portions of upper ends of wall surfaces at widthwise outer sides of both cavities 5. The wall surfaces project from the bottom surfaces at substantially right angles to the bottom surfaces in the longitudinal direction. The supporting stepped surfaces 18 extend substantially horizontally at substantially the same height as the partition wall 6. Outer edges of the supporting stepped surfaces 18 project at substantially right angles to have a short height, and upwardly inclined guide surfaces 20 are formed from the upper edges of these outer edges. The inclined guide surfaces 20 guide opposite widthwise edges of the cover 15 to the supporting stepped surface 18 along the inclination thereof. Sides before the inclined guide surfaces 20 are slightly higher than the inclined guide surfaces 20, and two guiding inclined surfaces 21 are formed at boundary parts to widen a space therebetween toward the back, as shown in FIG. 1. The guiding inclined surfaces 21 can slide in contact with the leading end of the cover 15 to correct the lateral position of the cover 15 when the cover 15 is being mounted. Substantially straight guides 22 are provided before and continuous with the guiding inclined surfaces 21. The substantially straight guides 22 extend forward in a specified length range. The locking walls 19 project in to connect to the inner surface of the front wall 10 before the straight guides 22 for preventing the cover 15 from coming out upward.

Figure 2:
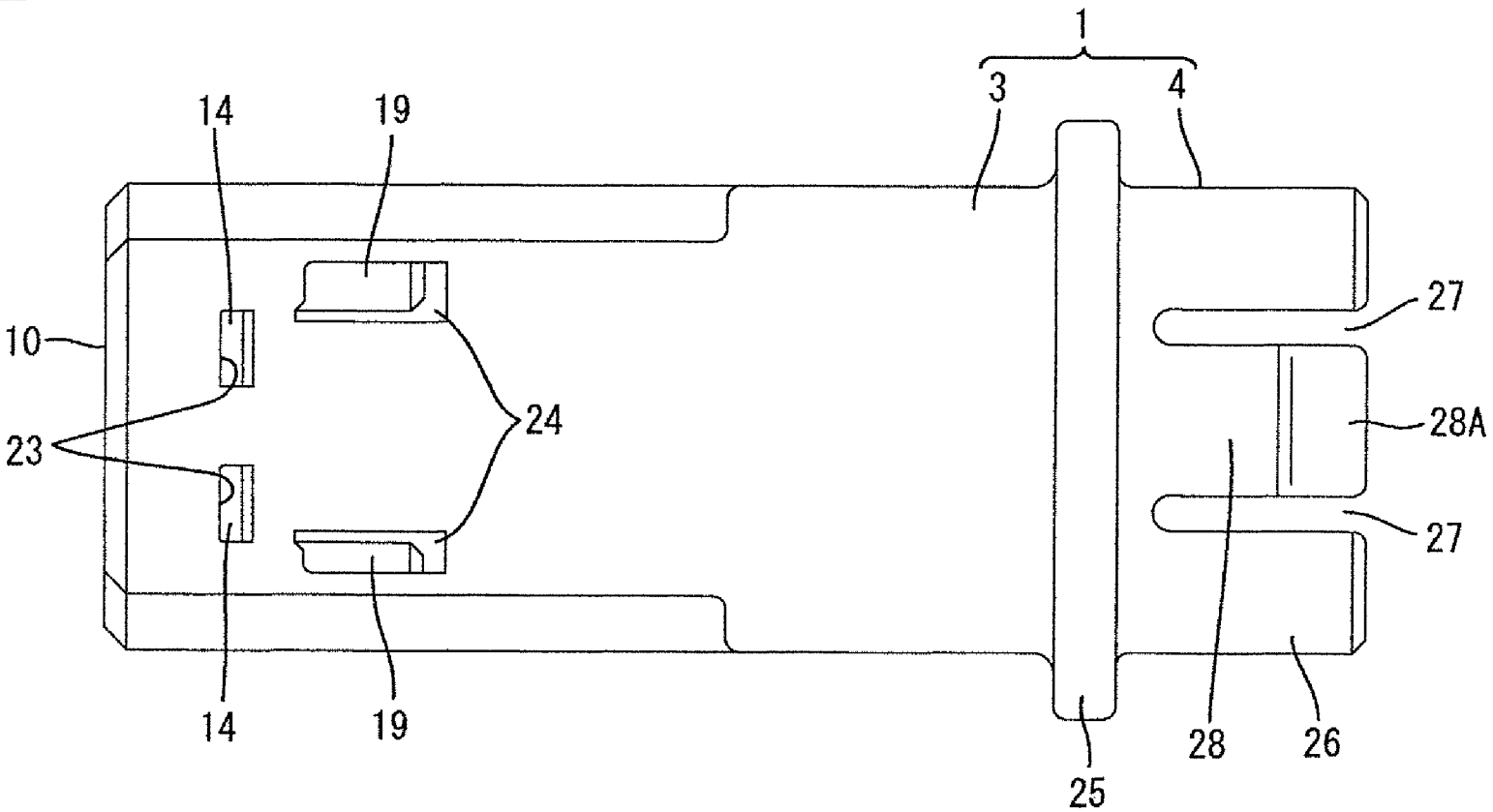
FIG. 2 is a bottom view of the connector housing.
Figure 3:
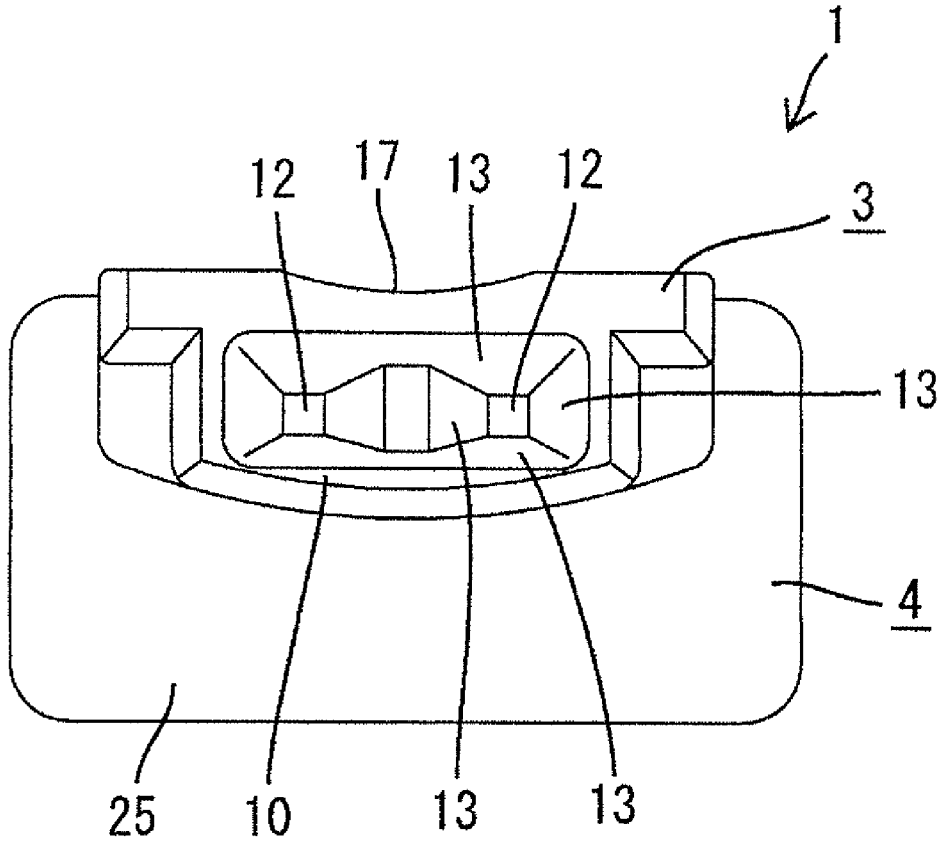
FIG. 3 is a front view of the connector housing.
Figure 4:
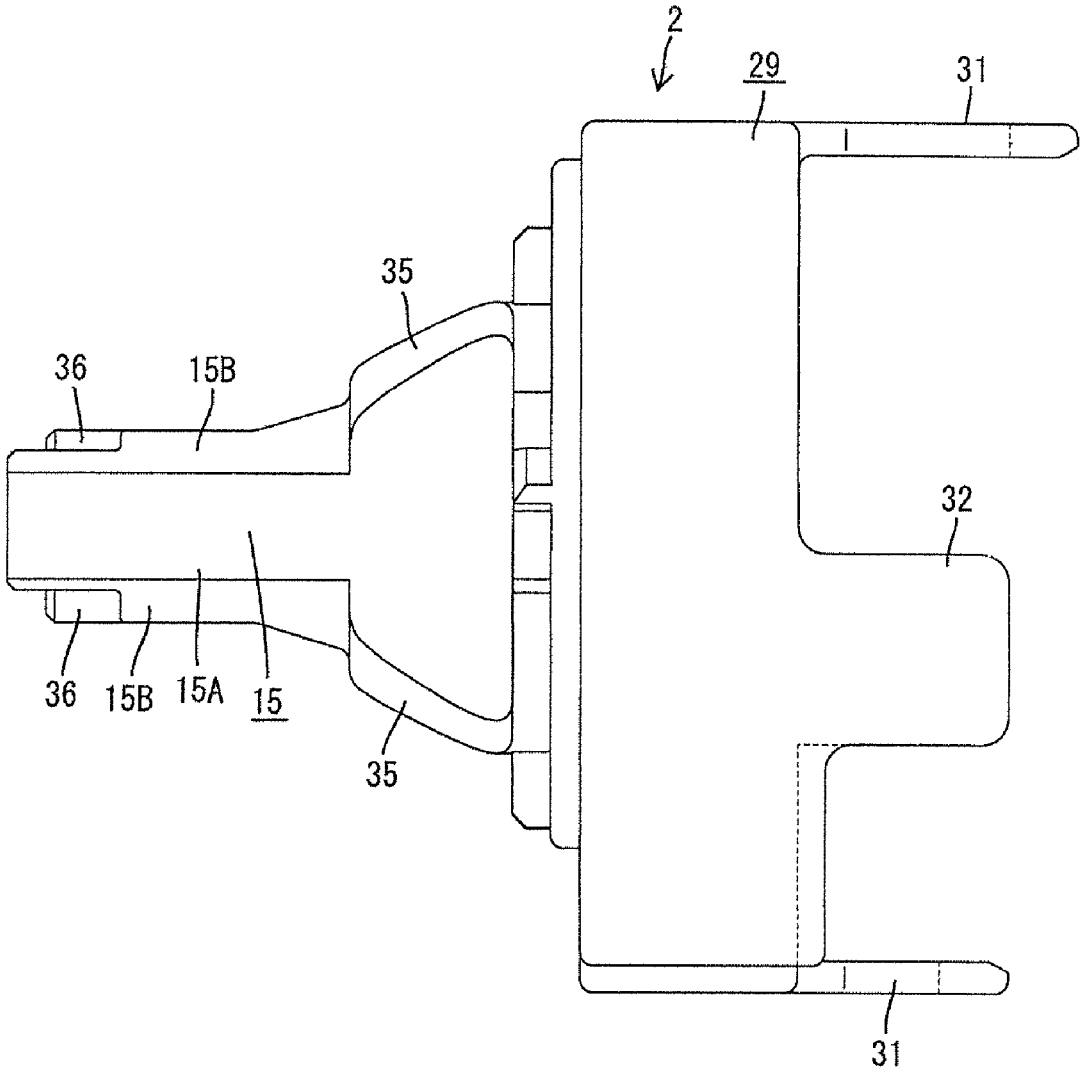
FIG. 4 is a plan view of a cover.
Figure 5:
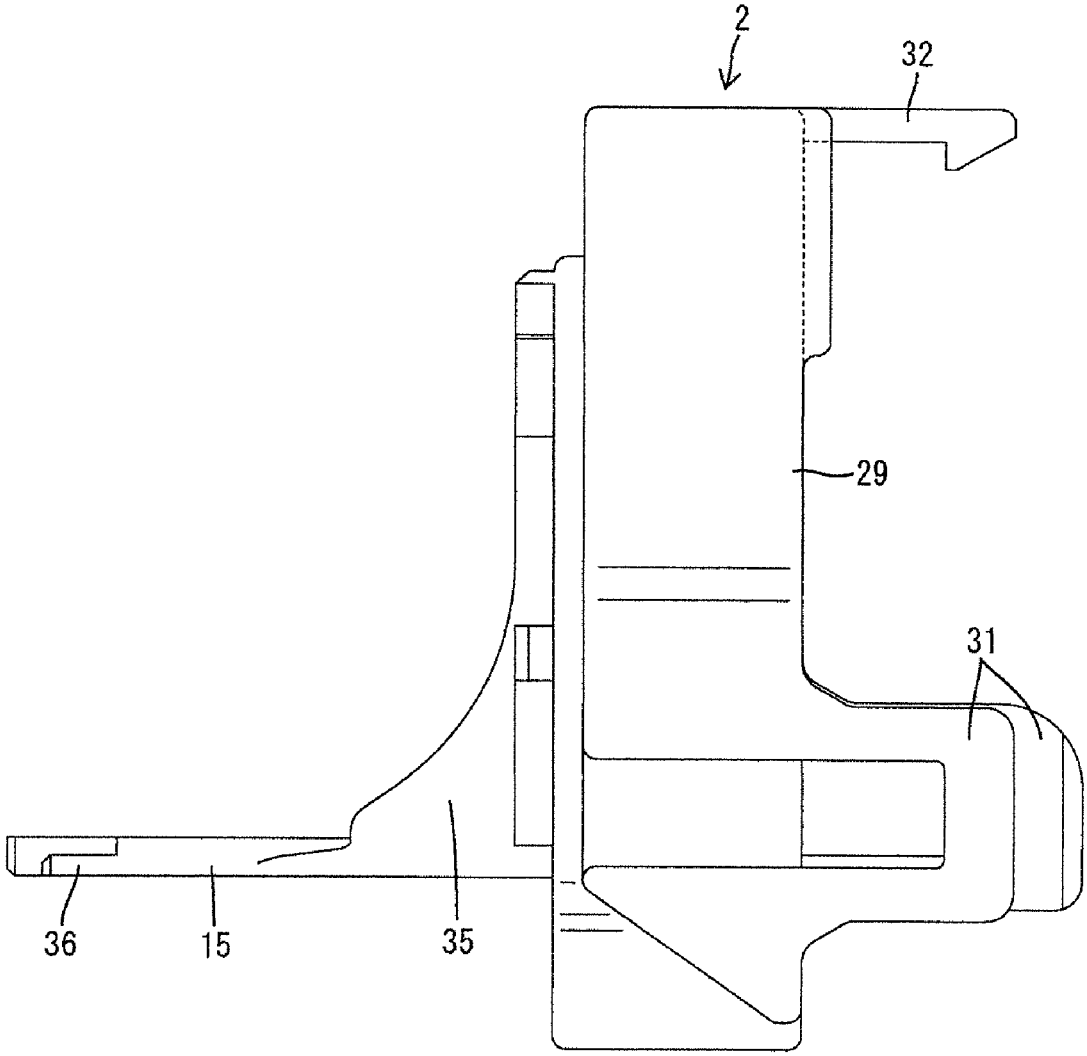
FIG. 5 is a side view of the cover.
Figure 6:
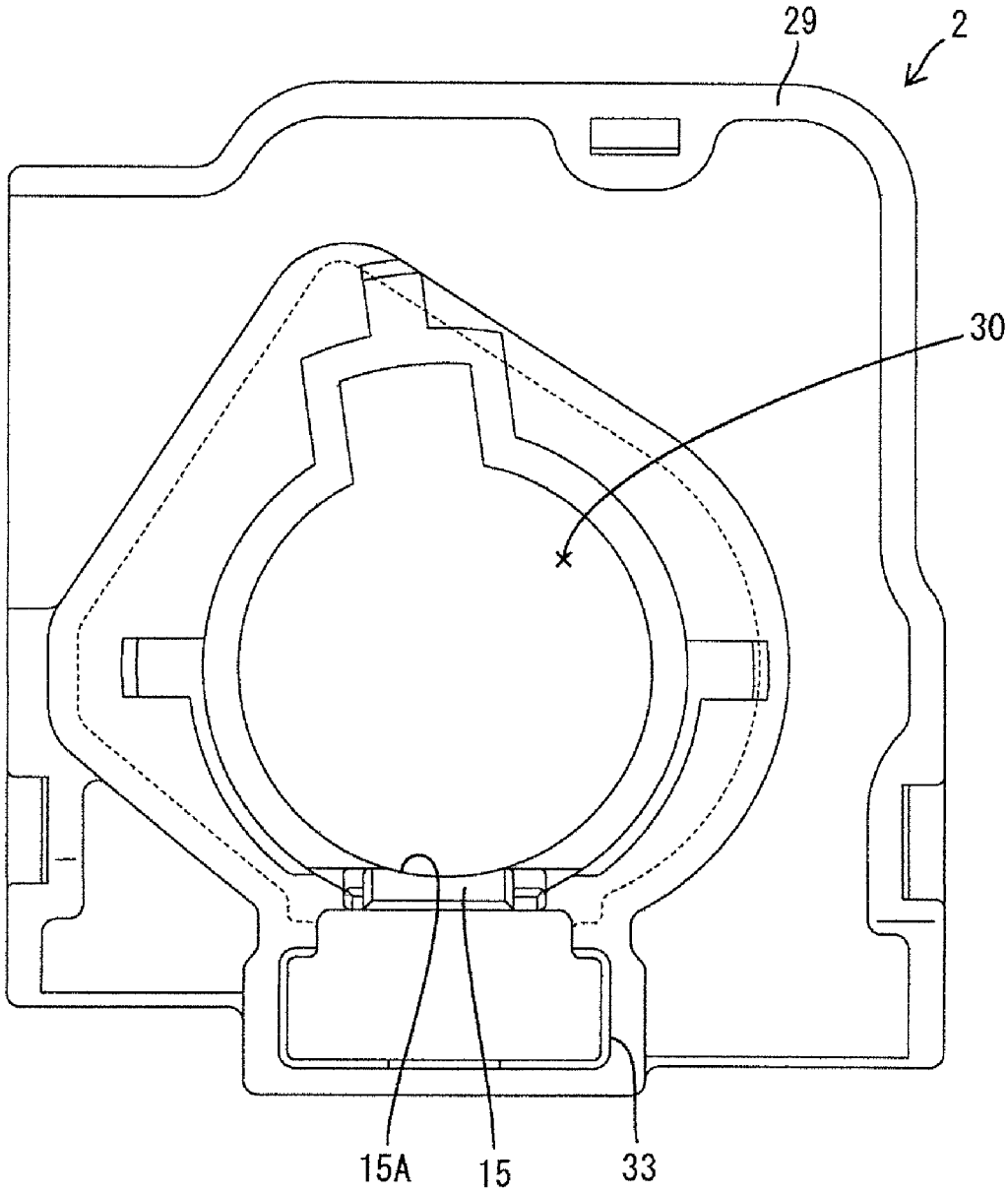
FIG. 6 is a front view of the cover.

As shown in FIG. 2, two mold removal holes 23 left upon forming the locking walls 19 and two mold removal holes 24 left upon forming the restricting walls 14 are formed at a front part of the lower surface of the main portion 3.

The connecting portion 4 of the housing 1 includes a substantially vertical wall 25 extending substantially down from the rear end surface of the main portion 3. The vertical wall 25 is wider than the main portion 3 and bulges out in the width direction from the main portion 3. A coupling piece 26 extends horizontally back from an outer surface of the vertical wall 25. The coupling piece 26 is a channel that opens up or out, and the upper or outer surface thereof is at substantially the same height as the lower surface of the main portion 3. Two slits 27 are formed from the rear end edge of the coupling piece 26 to the vicinity of the vertical wall 25. Thus, a lock arm 28 is formed between the slits 27 and is resiliently deformable up and down. A claw portion 28A projects down or in from a leading end portion of the lock arm 28 for locking the cover 2.

Figure 8:
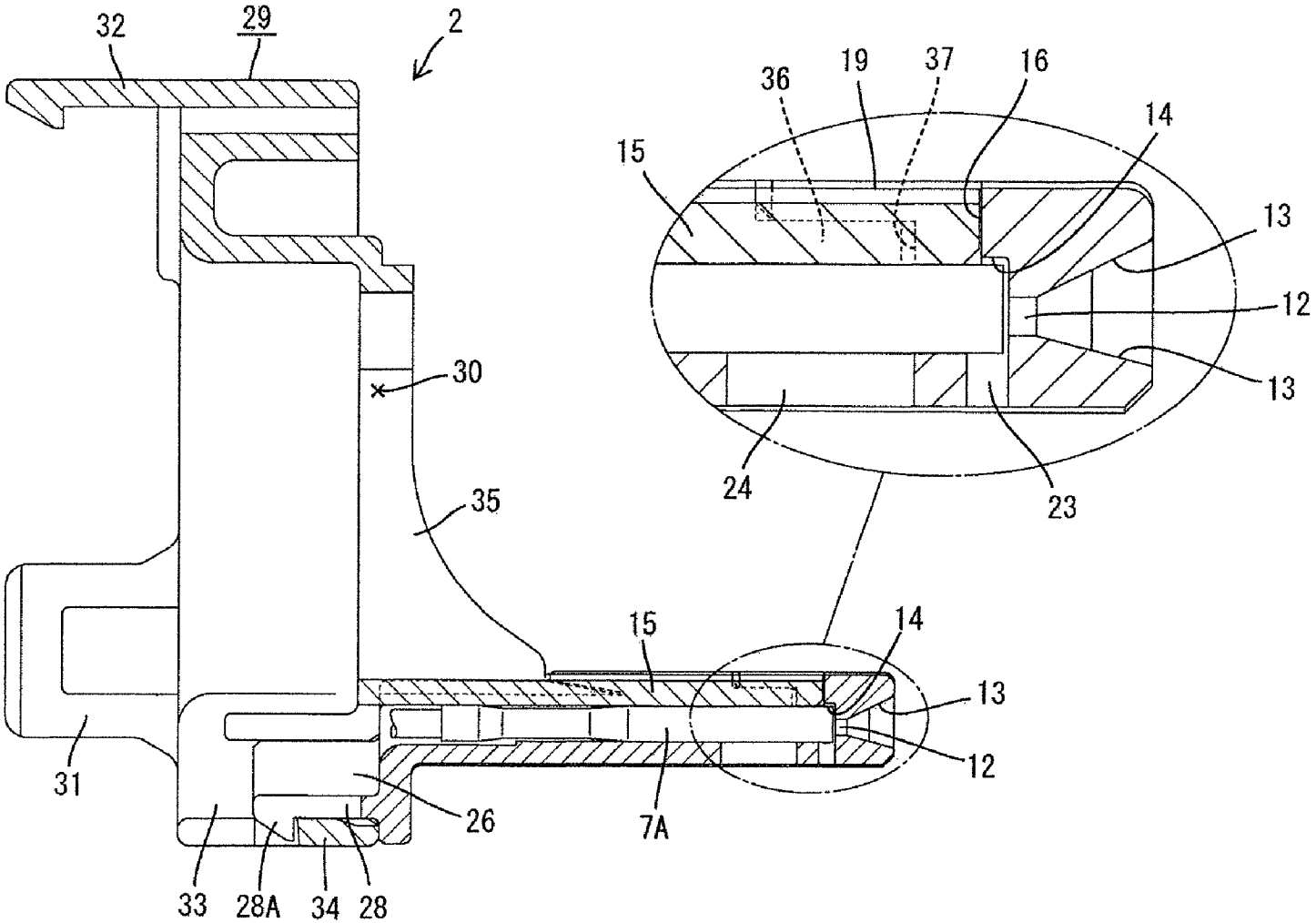
FIG. 8 is a side view in section showing a state where the cover is mounted on the connector housing.

The cover 2 also is made e.g. of synthetic resin and includes a holder 29 to be mounted on the shift lever and the cover portion 15 for closing the opening K of the housing 1. A through hole 30 is formed in the center of the holder 29 for receiving the shift lever (not shown). Two resiliently deformable coupling arms 31 extend back from opposite widthwise end edges of the holder 29, and a resiliently deformable locking claw 32 is formed near the widthwise center of the upper edge of the holder 29. The coupling arms 31 and locking claw 32 fix the cover 2 and the housing 1 to the shift lever. Further, a coupling frame 33 having open front and/or rear ends is formed at a bottom or inner part of the cover 2 and at a side of the through hole 30 substantially opposite to the locking claw 32, and the connecting portion 4 of the housing 1 is fittable into the coupling frame 33. A widthwise intermediate part of the lower rear edge of the coupling frame 33 is cut off to form a locking edge 34, and the lock arm 28 of the housing 1 is engageable therewith. The vertical wall 25 of the housing 1 is in contact with the front surface of the coupling frame 33 when the lock arm 28 engages the locking edge 34 (see FIG. 8).

Figure 9:
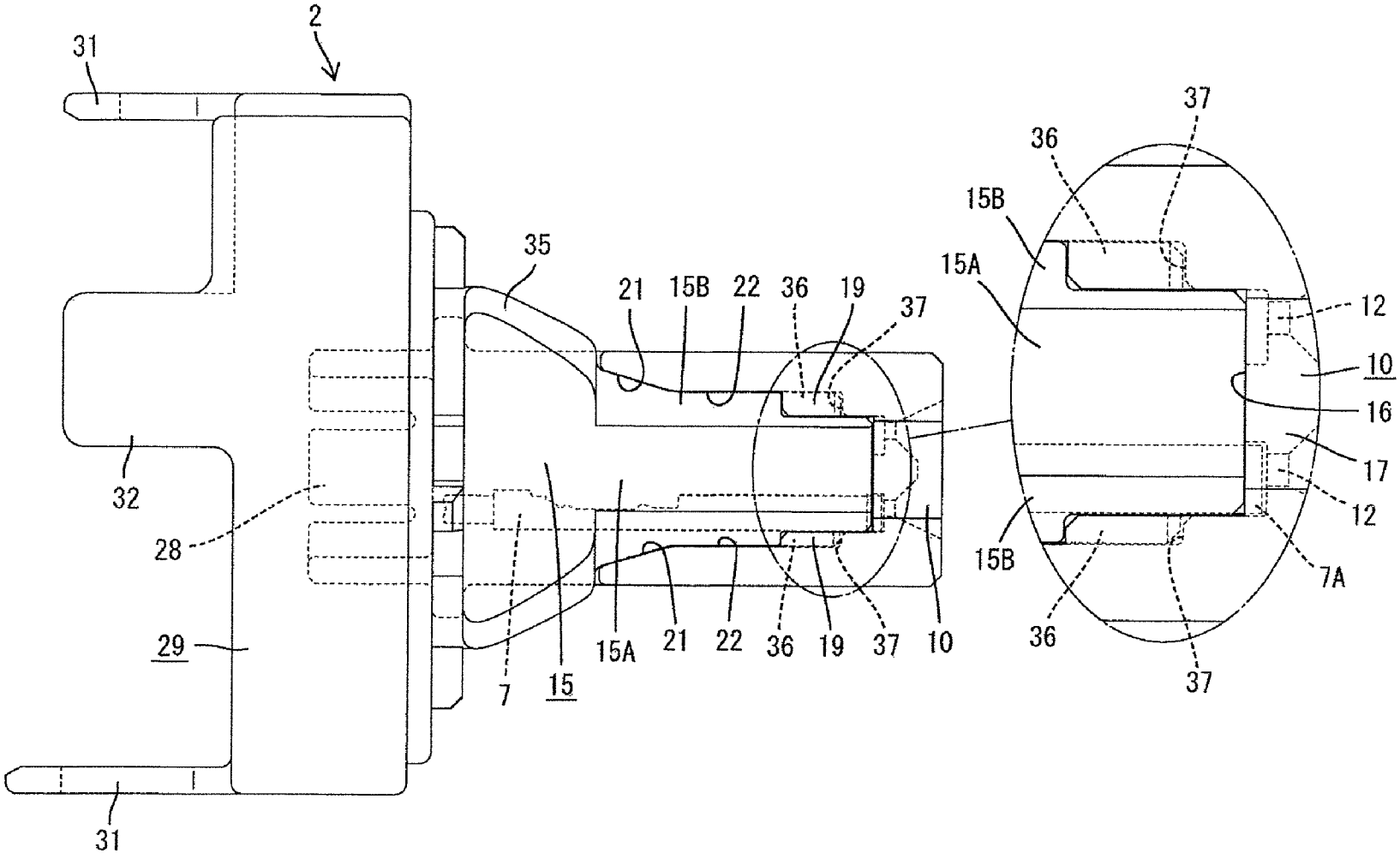
FIG. 9 is a plan view showing the state of FIG. 8.

The cover portion 15 projects forward from the edge of the through hole 30 adjacent to and right above the coupling frame 33. Reinforcing pieces 35 are provided at opposite sides of a base end part of the cover 15 and are connected to the edge of the through hole 30. Inner peripheral surfaces of the reinforcing pieces 35 are curved in conformity with the outer peripheral surface of the shaft of the shift lever. A part of the cover portion 15 before the reinforcing pieces 35 is a substantially flat plate formed with a length and width so that the cover portion 15 can be aligned with and close the opening K of the housing 1. The upper surface of a base portion 15A located in a widthwise central part of the cover portion 15 is formed entirely into an arcuate surface substantially in conformity with the outer peripheral surface of the shaft of the shift lever, and flat surfaces 15B extend substantially horizontally out at opposite widthwise ends of the base portion 15A. Opposite widthwise ends of the leading end of the cover portion 15 are thinned over a specified width. Lower surfaces of both thinned portions 36 are substantially flush with surrounding surfaces, but upper surfaces thereof are lower than surrounding surfaces to form steps. When the cover 2 is mounted properly on the housing 1, an area between the thinned portions 36 in the width direction is fit into a space surrounded by the locking walls 19 and the front wall 10 of the housing 1 and both thinned portions 36 slip under the corresponding locking walls 19 so that the leading end of the cover portion 15 is not lifted up. Front ends of the thinned portions 36 are retracted slightly back from the leading end edge of the cover portion 15. The leading ends of the thinned portions 36 contact stopper steps 37 formed at widthwise outer corners of front end portions of the cavities 5 when the cover 2 is mounted properly on the housing 1 (see FIGS. 8 and 9).

The connector is assembled by temporarily setting the female terminal fittings 7 in the cavities 5 in the housing 1. More particularly, the female terminal fittings 7 connected to the wires are located above the opening K of the housing 1 and then are accommodated into the respective cavities 5 with the leading ends of the rectangular tubes 7A slipped under the restricting walls 14. This causes the rear ends of the tubes 7A of the female terminal fittings 7 to be locked by the retaining portions 8. Therefore the entire female terminal fittings 7 are held so as not to come out backward. Further, the restricting walls 14 press the leading ends of the rectangular tubes 7A and prevent the leading ends of the female terminal fittings 7 from being lifted up. In this way, the female terminal fittings 7 are set temporarily to avoid a situation where the female terminal fittings 7 come out from the cavities 5 before the cover 2 is mounted.

The cover 2 then is mounted on the housing 1. First, the leading end of the cover portion 15 of the cover 2 is located at the rear end of the opening K of the main portion 3 and the thinned portions 36 are placed on the upper surfaces of the rear ends of the supporting stepped surfaces 18. The cover portion 15 may be displaced slightly in the width direction, but is guided to a proper position by the inclined guide surfaces 20. The properly placed cover portion 15 then is slid along a plane direction of the opening K on the upper surfaces of the supporting stepped surfaces 18 and the partition wall 6. The thinned portions 36 slip under the corresponding locking walls 19 in a forward moving process of the cover portion 15. When the cover portion 15 moves further forward, the leading ends of the thinned portions 36 contact the stopper steps 37 and the leading end of the cover portion 15 contacts the rear ends of the restricting walls 14 to define the front end position of the cover portion 15.

The connecting portion 4 of the housing 1 enters the coupling frame 33 of the cover 2 as the cover portion 15 moves forward and the lock arm 28 deforms resiliently. The lock arm 28 restores resiliently to engage the locking edge 34 of the coupling frame 33 when the cover portion 15 reaches the proper front end position, thereby mounting the cover 2 on the housing 1.

The cover 2 is mounted on the housing 1 with the opening K of the housing 1 closed by the cover portion 15. The cover portion 15 is slid in the plane direction of the opening K. Thus, the lower surface of the cover portion 15 is substantially at the same height as the upper surfaces of the cavities 5. Thus, the cover portion 15 and the rectangular tubes 7A of the female terminal fittings 7 are very close to each other with substantially no clearances therebetween, thereby preventing the female terminal fittings 7 from shaking vertically in the cavities 5. Further, the rectangular tubes 7A are surrounded closely by the inner surface of the front wall 19, the partition wall 6, the opposite side walls and the retaining portions 8 with substantially no clearances formed therebetween. Thus, the female terminal fittings 7 be also are prevented from shaking horizontally. Therefore, the rectangular tubes 7A and the tab insertion holes 12 are kept substantially aligned to ensure a smooth connecting operation with the tab-shaped terminals.

The sliding direction of the cover portion 15 when the cover portion 15 closes the opening K is from the rear toward the front of the housing 1. Thus, the leading end of the cover portion 15 contacts the inner surface of the front wall 10 to define the front end position. This enables the guiding surfaces 13 to be formed at four sides in the front surface of the front wall 10 to guide the tab-shaped terminals. Further, the position where the cover portion 15 contacts the front wall 10 lies in the height range of the guiding surfaces 13. Therefore the entire connector is small in the height direction.

The cover portion 15 is substantially flush with the surrounding surfaces of the housing 1 and does not become a useless projection. Thus, the connector can be made smaller in this respect as well. Further, the terminal fittings are retained by the retaining portions 8 that require no deformation spaces. Hence, the connector also is made smaller in the width direction since the deformation spaces are not necessary.

Further, at least one lock arm 28 of the housing 1 is engaged with at least one corresponding locking edge of the cover 2 to mount the cover 2 on the housing 1.

The invention is not limited to the above described and illustrated embodiment. For example, the following embodiments also are included in the scope of the invention.

The illustrated connector is to be incorporated into the shift lever device for automotive vehicle. However, the application is not so limited. Accordingly, the cover 2 may include only the cover portion 15, but not the holder 29.

The locking structure of the cover portion 15 is not limited to the one set on the connecting portion 4 as in the above embodiment. It is also possible to omit the connecting portion 4 from the housing 1 and employ a structure for locking the cover portion 15 at an appropriate position of the connector housing 1. The locking structure in this case may be of a so-called semi-locking type instead of being a resilient locking structure.

The cavities 5 are arranged in one height level in the above embodiment. However, they may be arranged in plural height levels. In this case, openings K may be formed in upper and lower surfaces. Further, the cover portion 15 may be used for other housings 1. In this case, plural housings 1 may be placed one over another in the height direction, and the uppermost one includes the cover portion 15.

Although the restricting walls 14 are provided in the above embodiment, they may be omitted. In this case, the lifting of the leading ends of the rectangular tubes 7A cannot be avoided, but the lifted-up leading ends of the rectangular tube portions 7A can be corrected to have horizontal postures in the process of moving the cover 2 forward.

What is claimed is:

1. A connector formed with at least one cavity for accommodating at least one respective terminal fitting, comprising:

a housing with opposite front and rear ends spaced apart along a longitudinal direction, the front end having a tab insertion hole for enabling mating of the terminal fitting with a mating terminal fitting, an opening extending into the housing in a direction transverse to the longitudinal direction to expose the cavity laterally to areas outside the housing over substantially an entire length of the cavity along the longitudinal direction of the housing so that the terminal fitting can be accommodated into the cavity through the opening and along the direction transverse to the longitudinal direction;

at least one restriction rigidly formed in the housing for engaging the terminal fitting and preventing the terminal fitting from coming out backward in the longitudinal direction; and a cover mounted on the housing to open or close the opening in a plane direction of the opening that is substantially parallel to the longitudinal direction of the housing.

2. The connector of claim 1, wherein the housing has a front wall, the tab insertion hole being configured for receiving a tab-shaped terminal as a connection partner of the terminal fitting and at least one guiding surface arranged substantially around the tab insertion hole in the front wall of the housing.

3. The connector of claim 1, wherein guides are formed on wall surfaces of the opening substantially facing each other and extending in the longitudinal direction for guiding a sliding movement of the cover when opening or closing the opening from a rear end toward the front end in the longitudinal direction.

4. The connector of claim 3, wherein the housing has a front wall at the front end of the housing, the cover contacts a part of an inner surface of the front wall to define a front end position of the cover.

5. The connector of claim 1, wherein at least one restricting wall projects in from the inner surface of the front wall for preventing a leading end of the terminal fitting from being lifted up by pressing an upper part of the leading end of the terminal fitting.

6. The connector of claim 5, wherein leading end surfaces of the restricting walls define stoppers that contact the cover to define a front end position of the cover when the cover is closed.

7. The connector of claim 1, wherein the cover is mounted on the housing to be flush with a wall surface of the housing around the cover.

8. The connector of claim 1, wherein at least one reinforcing piece is provided at a base end of the cover.

9. The connector of claim 1, wherein a sliding direction of the cover when the cover closes the opening is set at a direction from the rear toward the front of the housing.

10. A connector, comprising:

a housing with opposite front and rear ends spaced apart along a longitudinal direction, a front wall being formed at the front end, at least one cavity formed in the housing and extending substantially from the front wall to the rear end of the housing, an opening extending into the housing in a direction transverse to the longitudinal direction substantially from the front wall to the rear end of the housing for exposing the cavity laterally to areas outside the housing, at least one rigid restriction formed in the housing and projecting into the cavity;

at least one terminal fitting mounted through the opening and into the cavity in a direction transverse to the longitudinal direction, the rigid restriction engaging the terminal fitting for preventing the terminal fitting from moving rearward in the cavity; and a cover slidably mounted on the housing for movement in forward or rearward directions substantially parallel to the longitudinal direction and in a plane direction of the opening to open or close the opening.

11. The connector of claim 10, wherein guides are formed on wall surfaces of the opening substantially facing each other for guiding a sliding movement of the cover when closing the opening from the rear end toward the front end.

12. The connector of claim 11, wherein the cover contacts a part of an inner surface of the front wall overlapping an area corresponding to the guides to define a front end position of the cover.

13. The connector of claim 12, wherein the front wall has at least one insertion hole for a tab-shaped terminal as a connection partner of the terminal fitting and at least one guiding surface is arranged substantially around the insertion hole in the front wall.

14. The connector of claim 12, wherein at least one restricting wall projects rearward from the inner surface of the front wall for pressing an upper part of a leading end of the terminal fitting and preventing the leading end of the terminal fitting from being lifted up.

15. The connector of claim 14, wherein a leading end surface of the restricting wall defines at least one stopper that contacts the cover to define a front end position of the cover when the opening is closed.

16. The connector of claim 10, wherein the cover is flush with adjacent surfaces of the housing when the opening is closed.

17. The connector of claim 10, wherein the terminal fitting has a front end substantially at the front wall of the housing and a rear end connected to a wire, the rear end of the housing having at least one opening communicating with the cavity and accommodating the wire connected to the rear end of the terminal fitting.

18. The connector of claim 10, wherein the housing has a bottom surface aligned substantially parallel to the longitudinal direction and facing the opening, the housing further having sidewalls projecting up from the bottom surface at substantially opposite sides of the cavity, the rigid restriction projecting into the cavity from one of the sidewalls.

19. The connector of claim 10, wherein the at least one cavity comprises a plurality of cavities, the opening of the housing communicating with all of the cavities, the cover being configured for covering the opening that communicates with all of the cavities.

20. The connector of claim 1, wherein the housing further includes a wire accommodating opening at the rear end of the housing and communicating with the cavity at a position substantially opposite the tab insertion opening.

* * * * *